US005713432A

United States Patent [19]

Richter et al.

[11] Patent Number: 5,713,432

[45] Date of Patent: Feb. 3, 1998

[54] DRIVE FRAME FOR A SELF-PROPELLED ELEVATOR CAR

[75] Inventors: Utz Richter, Ebikon; Christoph Liebetrau, Menziken, both of Switzerland; Albrecht Morlock, Horb, Germany; Ortwin Piper, Schwieberdingen, Germany; Helmut Heizmann, Stuttgart, Germany

[73] Assignee: Inventio AG, Hergiswil, Switzerland

[21] Appl. No.: 656,104

[22] Filed: May 31, 1996

[30] Foreign Application Priority Data

Jun. 2, 1995 [CH] Switzerland ..... 01625/95

[51] Int. Cl.[6] ..... B66B 9/02

[52] U.S. Cl. ..... 187/250; 104/128

[58] Field of Search ..... 187/201, 231, 187/240, 249, 270, 271, 250, 410; 104/127, 128

[56] References Cited

U.S. PATENT DOCUMENTS

| | | | |
|---|---|---|---|
| 2,052,690 | 9/1936 | Austin | 187/249 |
| 5,636,712 | 6/1997 | Muller et al. | 187/249 |

FOREIGN PATENT DOCUMENTS

| | | |
|---|---|---|
| 0330809 | 9/1989 | European Pat. Off. . |
| 933675 | 4/1948 | France . |
| 3177290 | 8/1991 | Japan . |

*Primary Examiner*—Kenneth Noland
*Attorney, Agent, or Firm*—William J. Clemens

[57] ABSTRACT

A drive frame for a self-propelled elevator travelling on guide rail running surfaces (22) includes a car carrying frame (5,14,16,17,18) on which are mounted driving wheels (1) coupled to a drive unit (24) and supporting wheels (2). The driving wheels (1) are rotatably mounted on axle tubes (3) connected to the drive unit (24) and rocker arms (15) pivotally mounted on frame brackets (5). The supporting wheels (2) are rotatably mounted on an axle (12) mounted on axle carriers (4) extending from the frame brackets (5). The driving wheels (1) and the supporting wheels (2) are drawn into contact with the running surfaces (22) by spring cylinders (8) connected between the axle tubes (3) and the supporting wheel axle (12) and extending through lateral passages (13) formed in a frame crossbeam (14) connected between the frame brackets (5).

18 Claims, 2 Drawing Sheets

DRIVE FRAME FOR A SELF-PROPELLED ELEVATOR CAR

BACKGROUND OF THE INVENTION

The present invention relates generally to an apparatus for self-propelled elevator cars and, in particular, to a combination supporting frame and drive for such elevator cars.

Known elevators with friction wheel drives have different constructions, but generally include a drive unit with a motor, gearwheels, friction wheels and supporting wheels and contact pressure equipment mounted directly on or below an elevator car.

The French patent specification No. 933 675 describes and shows an elevator drive for a passenger elevator having a friction wheel drive running on round guide rails. A drive unit includes a motor and double worm gear, two drive axles, bearing blocks and grooved friction wheels at each end of each drive axle and is mounted on the upper side of the car structure. The drive elements are all individually installed on the car.

The multiple bearing of the drive axles at the worm gear and at the outer ends with separately mounted bearing blocks leads to the possibility of an overstressing of the drive axles because errors in alignment are not entirely avoidable with the arrangement shown. Also, contact pressure producing equipment for generating the necessary friction forces is not disclosed.

The Japanese patent application JP3177290 discloses a drive unit similar to the one described above. Two axles with grooved friction wheels at each end are mounted above or below an elevator car. One of the axles is driven by a motor-gear unit, wherein the driven axle drives the second axle by way of gearwheels. For production of the necessary friction force, the axles or the friction wheels are urged toward each other and thus the wheels are forced against the rolling surface of a rectangular guide by springs adjacent the wheels.

In this equipment, the elements of the drive are likewise separately installed on a car structure. In this configuration, there is the problem of changed tooth engagement at the gearwheels when the spacing between the axles becomes smaller due to the wear of the friction wheels. A kind of toothing would have to be provided which prevents the tooth tips of one gearwheel from ever bottoming in the spaces between the teeth in the other gearwheel, because the axles will be forced away from each other resulting in a loss of the frictional force at the friction wheels. Furthermore, the use of the shown open gearwheels on or below a car causes noise problems and contamination of the gears.

SUMMARY OF THE INVENTION

The present invention concerns a drive frame for a self-propelled elevator car travelling on guide rail running surfaces which drive frame includes a pair of generally vertically extending side beams, a yoke beam connected between upper ends of the side beams by a pair of gusset plates, a pair of frame brackets each attached to a lower end of an associated one of the side beams, each of the frame brackets having a support surface formed thereon for supporting an elevator car body, and a frame crossbeam connected at opposite ends thereof to the frame brackets and having lateral passages formed in the opposite ends thereof. A pair of rocker arms each are pivotally mounted at one end to an associated one of the frame brackets at a rocker bearing. A pair of axle tubes each have an inner end connected to one end of a drive unit and an outer end attached to an opposite end of an associated one of the rocker arms. A pair of driving wheels each are rotatably mounted on the outer end of one of the axle tubes and are coupled to the drive unit for rotation. An axle carrier is formed on each of the frame brackets and a supporting wheel axle is mounted at opposite ends thereof to the axle carriers and has a pair of supporting wheels rotatably mounted on the opposite ends thereof. A pair of contact pressure means each extend through the lateral passages and are connected between the supporting wheel axle and the axle tubes for drawing the driving wheels and the supporting wheels towards one another for contacting the guide rail running surfaces.

The contact pressure means can include a biasing spring mounted in a cylinder chamber for generating an active contact pressure force. A pressured fluid system can be connected to the cylinder chamber for assisting the biasing spring in generating the active contact pressure force and the pressured fluid system can utilize one of hydraulic and pneumatic fluids. In addition, the rocker arms extend upwardly at an angle from the rocker bearings to generate a passive contact pressure force adding to the active contact pressure force.

A plurality of guide rollers are mounted on carrier plates attached to opposite ends of the yoke beam for engaging the guide rails. The guide wheels are aligned on two orthogonal axes in a generally horizontal plane.

It is an object of the present invention to create a drive frame for a self-propelled elevator car which drive frame does not have the above-mentioned disadvantages and, in particular, is easier to manufacture, prefabricatable as a subassembly and performs the functions of an elevator car frame. The present invention enables a simple and time-saving assembly of the drive frame with the car.

It is another object of the present invention to protect the friction wheels of the drive by mounting them above the lowermost structural portion of the drive frame.

A further object of the present invention is to provide for simple substitution of a second drive unit and driving wheels for the supporting axle and wheels.

Another object of the present invention is that by an appropriate choice of the articulation geometry for the driving wheels, a passive contact pressure force component is created at the friction wheels.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
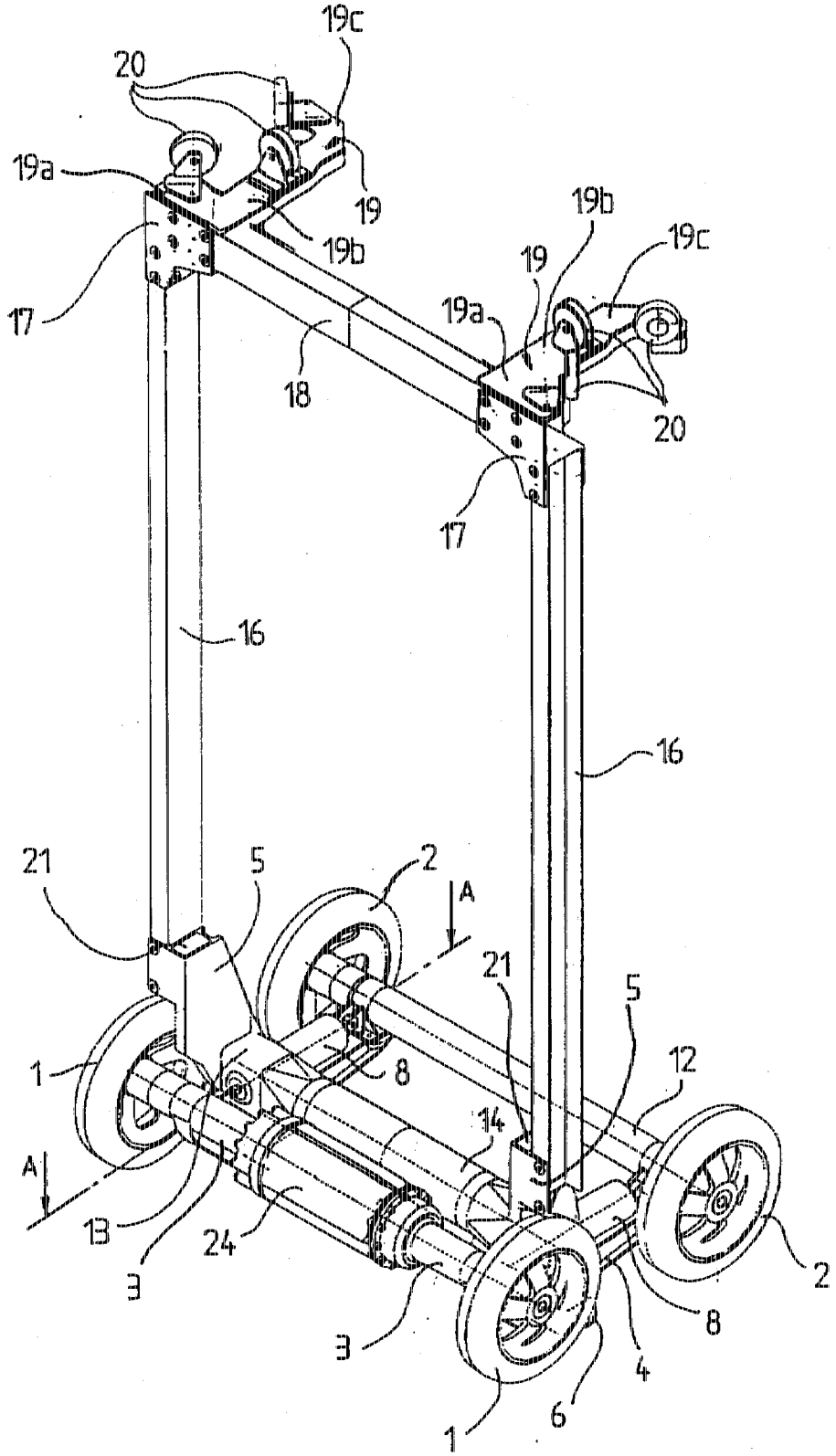
FIG. 1 is a perspective view of a drive frame apparatus for a self-propelled elevator car in accordance with the present invention.

There is shown in the FIG. 1 a drive frame including a pair of spaced apart, generally vertically extending side beams 16 which are connected at upper ends thereof by a pair of gusset plates 17 to opposite ends of a generally horizontally extending yoke beam 18. A pair of generally horizontally extending, L-shaped carrier plates 19 each have a shorter leg 19*a* attached to an upper surface of the yoke beam (18) adjacent an associated one of the gusset plates 17. The carrier plates 19 each have a longer leg 19*b* extending outwardly from the yoke beam 18 and an angled extension 19*c* extending from an outer end of the leg 19*b* at an angle of about 60°. One of a plurality of guide rollers 20 is rotatably mounted on an upper surface of each of the shorter leg 19*a*, the longer leg 19*b* and the angled extension 19*c*. The guide rollers (20) are aligned on two mutually orthogonal axes to guide the upper end of the drive frame in a generally horizontal plane. The lower ends of the side beams 16 each are attached to a respective one of a pair of frame brackets 5 which brackets are transversely connected by a generally horizontally extending tubular frame crossbeam 14 with a lateral passage 13 formed at each end thereof.

Figure 3:
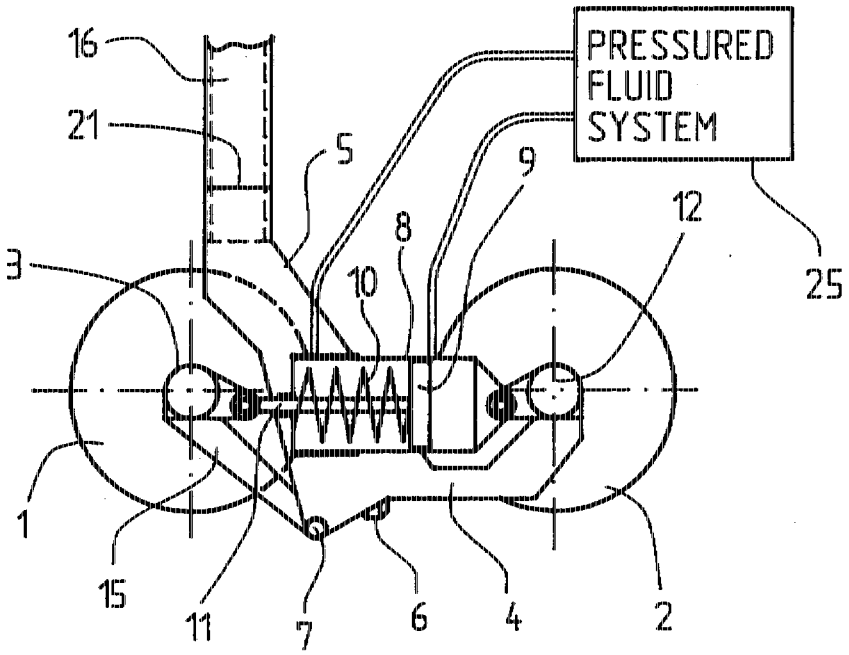
FIG. 3 is an enlarged cross-sectional view of the drive frame apparatus as if taken along the line A----A in the FIG. 1.
Figure 2:
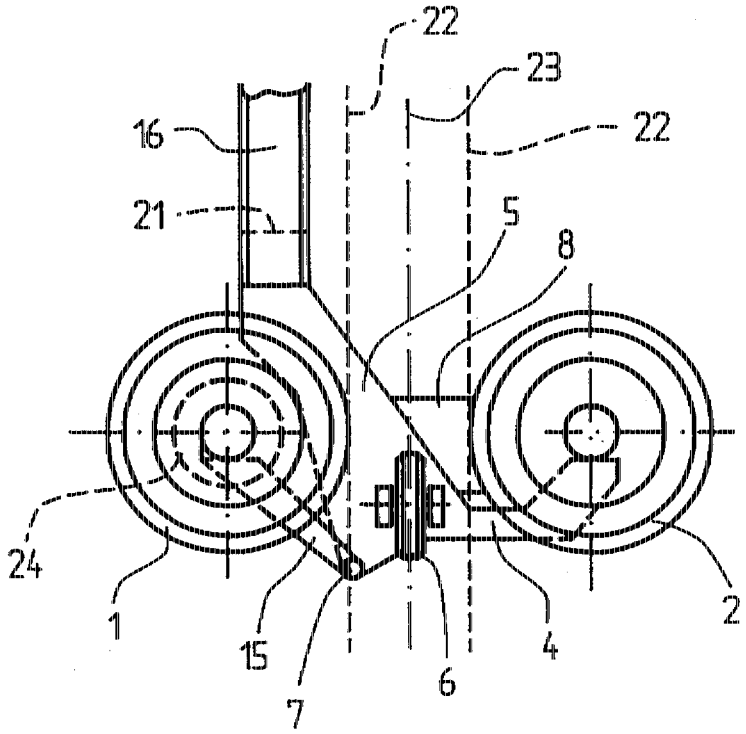
FIG. 2 is an enlarged side elevation view of a lower portion of the drive frame apparatus shown in the FIG. 1.

The frame brackets 5 each include a lateral prolongation or axle carrier 4 at the outer ends of which is mounted a supporting wheel axle 12, as best seen in the FIGS. 2 and 3. A drive unit 24 is connected between inner ends of a pair of axle tubes 3 which have outer ends coupled at a lowest portion of the respective frame brackets 5 so as to be pivotally movable. The axle tubes 3 are drawn towards the frame brackets 5 by a pair of contact pressure means such as spring cylinders 8 mounted in the respective lateral passages 13. The drive unit 24 includes an electrical motor, a brake and a reduction gear which are coaxially assembled. A pair of driving wheels 1 are rotatably mounted at the outer ends of the axle tubes 3 and a pair of supporting wheels 2 are rotatably mounted at opposite ends of the supporting wheel axle 12. A pair of guide rollers 6 are rotatably mounted on the outer sides of the frame brackets 5 for lateral guidance of the lower portion of the drive frame. The frame brackets 5 each have a generally horizontally extending support surface 21 which projects as an upper termination from the lower end of the side beam 16 towards the interior of the drive frame and serves as support for an elevator car body (not shown).

In the FIG. 2, the guide roller 6 is shown as being mounted centrally between the driving wheel 1 and the supporting wheel 2. The frame bracket 5 extends downwardly to a generally blunt point at its lowest portion on which a rocker bearing 7 is mounted. One end of a rocker arm 15 is pivotally mounted on the bearing 7 and, as best shown in the FIG. 3, the arm extends to an opposite end attached to the axle tube 3. The axle tube 3 also is connected to the supporting wheel axle 12 by the spring cylinder 8. The spring cylinder 8 includes a piston rod 11 which is attached at one end to the axle tube 3 at an opposite end to a spring piston 9 slidable in an interior of a cylinder chamber. A biasing spring 10, preferably in the form of plate spring packets, is positioned between a left-hand end wall of the cylinder chamber and the spring piston 9. The spring cylinder 8 has an outer diameter which is less than a diameter of the lateral passage 13 in the frame crossbeam 14 to provide room for movement of the spring cylinder. Also shown in the FIG. 2 are a pair of running surfaces 22 on opposite sides of a guide rail and a central axis 23 of the guide rail.

The function of the drive frame is to support, guide and propel an elevator car along a pair of guide rails in an elevator shaft. The force exerted by the biasing springs 10 in the spring cylinders 8 urges the wheels 1 and 2 against the running surfaces 22 with an active contact pressure force thus obtaining the frictional contact necessary for a low-slip drive along the guide rails.

By means of the articulation geometry of the driving wheels 1, an additional contact pressure force can be produced passively by the weight of the elevator car and the drive frame components. A downwardly acting force component of weight acts through the rocker bearing 7 to generate an horizontal force component tending to move the bearing, the rocker arm 15 and the attached driving wheel 1 to the right relative to the contact point of the driving wheel on the associated running surface 22. This horizontal component of passive contact pressure force is added to the active contact pressure force applied by the spring cylinder 8. In addition, when the driving wheel 1 is braked by the drive unit 24 while travelling in a downward direction, the friction caused by the spring force and adhesion of the driving wheel to the running surface 22 causes rotation of the rocker arm 15 in a clockwise direction applying an additional horizontal force component acting to the right as viewed in the FIG. 2.

The spring force generated by the spring cylinder 8 can be assisted by conventional a conventional pressured fluid system 25, either hydraulic or pneumatic, connected to the cylinder chamber of the spring cylinder 8 on opposite sides of the spring piston 9. The spring piston 9 would be sealed against the interior wall of the cylinder chamber and a stuffing box seal utilized to seal the aperture where the piston rod 11 extends through the end wall of the cylinder chamber.

To increase or double the driving power, a second drive unit 24 with the axle tubes 3 and the driving wheels 1 can be provided in place of the supporting wheel axle 12 and the supporting wheels 2 without changing the basic concept. The outer ends of the tube axles 3 can be connected in a like manner to the axle carriers 4 to form a dual drive drive frame.

In summary, a drive frame for a self-propelled elevator car travelling on guide rail running surfaces (22) includes a pair of generally vertically extending side beams (16), a yoke beam (18) connected between upper ends of the side beams by a pair of gusset plates (17), a pair of frame brackets (5) each attached to a lower end of an associated one of the side beams, each of the frame brackets having a support surface (21) formed thereon for supporting an elevator car body, and a frame crossbeam (14) connected at opposite ends thereof to the frame brackets and having lateral passages (13) formed in the opposite ends thereof. A pair of rocker arms (15) each are pivotally mounted at one end to an associated one of the frame brackets (5) at a rocker bearing (7). A pair of axle tubes (3) each have an inner end connected to one end of a drive unit (24) and an outer end attached to an opposite end of an associated one of the rocker arms (15). A pair of driving wheels (1) each are rotatably mounted on the outer end of one of the axle tubes (3) and are coupled to the drive unit (24) for rotation. An axle carrier (4) is formed on each of the frame brackets (5) and a supporting wheel axle (12) is mounted at opposite ends thereof to the axle carriers and has a pair of supporting wheels (2) rotatably mounted on the opposite ends thereof. A pair of spring cylinders (8) each extend through the lateral passages (13) and are connected between the supporting wheel axle (12) and the axle tubes (3) for drawing the driving wheels (1) and the supporting wheels (2) towards one another for contacting the guide rail running surfaces (22).

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A drive frame for a self-propelled elevator car travelling along guide rail running surfaces (22), the drive frame including a frame (16,17,18) for carrying a car body, a drive unit (24) coupled to driving wheels (1) and supporting wheels (2), the driving wheels and the supporting wheels being drawn towards one another and urged against the running surfaces by spring force, comprising:

a frame crossbeam (14);

a pair of frame brackets (5) connected to opposite ends of said frame crossbeam (14) for mounting a drive unit (24) coupled to driving wheels (1) and adapted to be attached to a frame (16,17,18) for carrying a car body;

an axle carrier (4) on each of said frame brackets (5); and at least one of a supporting wheel axle (12) mounted on said axle carriers (4) for rotatably mounting a pair of supporting wheels (2) and a pair of axle tubes (3) connected between a drive unit (24) and said axle carriers (4) for rotatably mounting a pair of driving wheels (1).

2. The drive frame according to claim 1 wherein said supporting wheel axle (12) is mounted at opposite ends thereof to said axle carriers (4) and including a pair of said axle tubes (3), each coupled to an associated one of said frame brackets (5) by a rocker and (15) having one end pivotally mounted on said frame bracket (5) and an opposite end attached to said axle tube (3), and a drive unit (24) connected between inner ends of said axle tubes (3) for driving a pair of driving wheels (1) rotatably mounted on outer ends of said axle tubes (3).

3. The drive frame according to claim 2, including a contact pressure means (8) connected between each of said axle tubes (3) and said supporting wheel axle (12) for drawing said axle tubes (3) toward said supporting wheel axle (12) to generate an active contact pressure force.

4. The drive frame according to claim 3 wherein said contact pressure means (8) includes a biasing spring (10) mounted in a cylinder chamber for generating said active contact pressure force.

5. The drive frame according to claim 4 including a pressured fluid system (25) connected to said cylinder chamber of said contact pressure means (8) for assisting said biasing spring (10) in generating said active contact pressure force.

6. The drive frame according to claim 5 wherein said pressured fluid system (25) utilizes one of hydraulic and pneumatic fluids.

7. The drive frame according to claim 3 wherein said contact pressure means (8) extends through a pair of lateral passages (13) formed in said opposite ends of said frame crossbeam (14).

8. The drive frame according to claim 3 wherein said one end of each said rocker arm (15) is pivotally mounted on a rocker bearing (7) attached to said associated frame bracket (5), said rocker arm (15) extending upwardly at an angle from said rocker bearing (7) to generate a passive contact pressure force adding to said active contact pressure force.

9. The drive frame according to claim 1 including a pair of driving wheels (1) rotatably mounted on said outer ends of said axle tubes (3) and a pair of supporting wheels (2) rotatably mounted on opposite ends of said supporting wheel axle (12) and wherein said driving wheels (1) and said supporting wheels (2) do not project below a lowest part of said frame brackets (5).

10. The drive frame according to claim 1 wherein said pair of axle tubes (3) have inner ends connected to opposite ends of a drive unit (24) and said outer ends of said axle tubes (3) are connected to associated ones of said axle carriers (4) and including a pair of driving wheels (1) coupled for rotation by said drive unit (24) and being rotatably mounted on said outer ends of said axle tubes (3).

11. The drive frame according to claim 1 including a pair of generally vertically extending side beams (16) and a yoke beam (18) connected between upper ends of said side beams (16) by a pair of gusset plates (17) and wherein said frame brackets (5) are each attached to a lower end of an associated one of said side beams (16) and each said frame bracket (5) has a support surface (21) formed thereon for supporting an elevator car body.

12. The drive frame according to claim 1 including a pair of generally vertically extending side beams (16) attached at lower ends thereof to an associated one of said frame brackets (5), a yoke beam (18) connected between upper ends of said side beams (16) by a pair of gusset plates (17) and a plurality of guide rollers (20) mounted at opposite ends of said yoke beam (18) for engaging guide rafts.

13. The drive frame according to claim 12 wherein said guide wheels (20) are aligned on two orthogonal axes in a generally horizontal plane.

14. A drive frame for a self-propelled elevator car travelling on guide rail running surfaces (22), the drive frame including a car body supporting frame (16,17,18) with driving wheels (1) and supporting wheels (2), comprising:

a pair of frame brackets (5) adapted to be attached to a lower end of car body supporting frame (16,17,18);

a frame crossbeam (14) connected at opposite ends thereof to said frame brackets (5);

a pair of rocker arms (15) each pivotally mounted at one end to an associated one of said frame brackets (5);

a drive unit (24);

a pair of axle tubes (3) each having an inner end connected to one end of said drive unit (24) and an outer end attached to an opposite end of an associated one of said rocker arms (15) for rotatably mounting a pair of driving wheels (1) said outer ends;

an axle carrier (4) on each of said frame brackets (5);

a supporting wheel axle (12) mounted at opposite ends thereof to said axle carriers (4) for rotatably mounting a pair of supporting wheels (2) on said opposite ends; and a pair of spring cylinders (8) each being connected between said supporting wheel axle (12) and one of said axle tubes (3) for drawing said axle tubes (3) and said supporting wheel axle (12) towards one another.

15. The drive frame according to claim 14 wherein each said spring cylinder (8) includes a biasing spring (10) mounted in a cylinder chamber for generating active contact pressure force.

16. The drive frame according to claim 15 including a pressured fluid system (25) connected to said cylinder chambers of said spring cylinders (8) for assisting said biasing spring (10) in generating said active contact pressure force.

17. The drive frame according to claim 14 wherein said spring cylinders (8) extend through a pair of lateral passages (13) formed in said opposite ends of said frame crossbeam (14).

18. A drive frame for a self-propelled elevator car travelling on guide rail running surfaces (22) comprising:

a pair of generally vertically extending side beams (16);

a yoke beam (18) connected between upper ends of said side beams (16) by a pair of gusset plates (17);

a pair of frame brackets (5) each attached to a lower end of an associated one of said side beams (16), each said frame bracket (5) having a support surface (21) formed thereon for supporting an elevator car body;

a frame crossbeam (14) connected at opposite ends thereof to said frame brackets (5) and having lateral passages (13) formed in said opposite ends;

a pair of rocker arms (15) each pivotally mounted at one end to an associated one of said frame brackets (5);

a drive unit (24);

a pair of axle tubes (3) each having an inner end connected to one end of said drive unit (24) and an outer end attached to an opposite end of an associated one of said rocker arms (15);

a pair of driving wheels (1) each rotatably mounted on said outer end of one of said axle tubes (3);

an axle carrier (4) on each of said frame brackets (5);

a supporting wheel axle (12) mounted at opposite ends thereof to said axle carriers (4) and having a pair of supporting wheels (2) rotatably mounted on said opposite ends; and a pair of spring cylinders (8) each extending through one of said lateral passages (13) and being connected between said supporting wheel axle (12) and one of said axle tubes (3) for drawing said driving wheels (1) and said supporting wheels (2) towards one another for contacting guide rail running surfaces (22).

* * * * *